US006300048B1

(12) United States Patent
Puppo et al.

(10) Patent No.: US 6,300,048 B1
(45) Date of Patent: Oct. 9, 2001

(54) PHOTOGRAPHIC ELEMENT WITH A LAYER IMPROVING THE ADHESION TO THE SUPPORT

(76) Inventors: Paola Puppo; Carlo Barlocco; Alberto Valsecchi, all of I-17014 Cairo Montenotte/Ferrania, (Savona) (IT)

( * ) Notice: Subject to any disclaimer, the term of this patent is extended or adjusted under 35 U.S.C. 154(b) by 0 days.

(21) Appl. No.: 09/559,892

(22) Filed: Apr. 26, 2000

(30) Foreign Application Priority Data

May 7, 1999 (IT) ..... SV99A0012

(51) Int. Cl.[7] ..... G03C 1/85; G03C 1/93

(52) U.S. Cl. ..... 430/527; 430/534; 430/535; 430/536

(58) Field of Search ..... 430/534, 535, 430/536, 527

(56) References Cited

U.S. PATENT DOCUMENTS

| | | | | |
|---|---|---|---|---|
| 4,328,283 | * | 5/1982 | Nakadate et al. | 430/534 |
| 4,389,479 | * | 6/1983 | Bishop et al. | 430/536 |
| 4,571,379 | * | 2/1986 | Yamazaki et al. | 430/535 |
| 5,079,136 | * | 1/1992 | Tachibana et al. | 430/536 |
| 5,441,856 | | 8/1995 | Merkel et al. . | |
| 5,705,329 | | 1/1998 | Nakajima et al. | 430/536 |
| 5,879,868 | | 3/1999 | Uchida . | |

FOREIGN PATENT DOCUMENTS

| | | |
|---|---|---|
| 2711220 | 10/1977 | (DE) . |
| 0258903 | 3/1988 | (EP) . |
| 0301827 | 2/1989 | (EP) . |
| 0361948 | 4/1990 | (EP) . |
| 0372105 | 6/1990 | (EP) . |
| 0549489 | 6/1993 | (EP) . |
| 0622667 | 11/1994 | (EP) . |
| 0725312 | 8/1996 | (EP) . |
| 0729063 | 8/1996 | (EP) . |
| 0751423 | 1/1997 | (EP) . |
| 1496967 | 1/1978 | (GB) . |
| 3220551 | 9/1991 | (JP) . |
| 4177241 | 6/1992 | (JP) . |
| 9413481 | 6/1994 | (WO) . |

* cited by examiner

*Primary Examiner*—Richard L. Schilling
(74) *Attorney, Agent, or Firm*—Mark A. Litman & Assoc. P.A.

(57) ABSTRACT

A photographic element comprising a film support base, an adhesion promoting layer, a subbing layer and at least one light-sensitive silver halide emulsion layer, wherein the adhesion promoting layer is close to the support and contains a self-crosslinkable vinyl addition copolymer and the subbing layer is positioned between the adhesion promoting layer and the emulsion layer.

The present invention also refers to a photographic element comprising a film support base having coated on one side thereof at least one light-sensitive silver halide emulsion layer and on the opposite side thereof an adhesion promoting layer and at least one auxiliary layer, wherein the adhesion promoting layer is close to the support and contains a self-crosslinkable vinyl addition copolymer.

The present invention further refers to a film support base having coated on at least one side thereof an adhesion promoting layer and a subbing layer, wherein the adhesion promoting layer is close to the support and contains a self-crosslinkable vinyl addition copolymer and the subbing layer is selected among the group consisting of a hydrophilic colloid layer or layers comprising a continuous gelled network of inorganic particles.

The adhesion of emulsion layers and/or of auxiliary layers to the support base are improved both in wet and dry conditions.

17 Claims, No Drawings

PHOTOGRAPHIC ELEMENT WITH A LAYER IMPROVING THE ADHESION TO THE SUPPORT

FIELD OF THE INVENTION

This invention relates to photographic elements having a film support carrying an adhesion promoting layer on at least one side of the support.

BACKGROUND

As materials for a support for a photographic material, polyester supports, such as polyethylene terephthalate (PET) and polyethylene naphthalate (PEN), triacetyl cellulose, polystyrene, polycarbonate and polyolefin laminate are usually employed due to their excellent transparency. However, such polymer film has a hydrophobic surface, and therefore it is difficult to firmly bond a photographic emulsion layer comprising a hydrophilic polymer (hydrophilic colloid) mainly containing gelatin on the support of the polymer in the case of employing the polymer as the base film of the support for the photographic material.

Two processes can be utilised as a conventional technique which has been tried to overcome the above difficulty: (1) a process in which a photographic emulsion layer is directly formed on the support to obtain a high bonding strength after having provided the support with a surface activation treatment such as a corona discharge treatment, a glow discharge treatment, an active plasma treatment, a chemical treatment, a mechanical treatment, a UV treatment and similar and (2) a process in which an adhesion promoting layer is provided on the support subjected to the above surface treatment by coating, and then a photographic emulsion layer is formed thereon. The latter process is effective so that it is widely performed.

It is assumed that any of these surface treatments is effected by forming some polar groups on a surface of a base film which is originally hydrophobic and by increasing a cross linking density on a surface, and as a result, it is considered that the affinity of the components contained in the adhesion promoting layer with the polar group is increased or the bonding strength between the adhesion promoting layer and the base film is enhanced.

Some useful compositions for adhesion promoting layers include polymers containing vinylidene chloride such as vinylidene chloride/methyl acrylate/itaconic acid terpolymers or vinylidene chloride/acrylonitrile/acrylic acid and the like; butadiene-based copolymers, glycidyl acrylate or methacrylate containing copolymers, or maleic anhydride-containing copolymers. These and other suitable compositions described, for example, in U.S. Pat. Nos. 2,627,088; 2,698,240; 2,943,937; 3,143,421; 3,201,249; 3,271,178; 3,443,950 and 3,501,301 provide the required adhesion when applied before orientation but are not effective when applied on oriented support. The effectiveness of these adhesive materials may be enhanced by the use of swelling or attack agents such as resorcinol.

An alternative approach disclosed in U.S. Pat. No. 4,695,532 describes a discharge-treated polyester film support having coated directly thereon a crosslinked layer of an aqueous vinyl acrylate copolymer and gelatine mixture. Although this system has good adhesion before processing, the adhesion performance is severely degraded by photographic developing solutions.

U.S. Pat. No. 4,689,359 discloses a polymer composition comprising (a) 1–60 wt. % of recurring units from a vinyl monomer having a primary amine addition salt component and/or a vinyl monomer having an aminostyrene addition salt component; (b) 0–50 wt. % recurring units derived from a hydrophilic vinyl monomer and (c) 20–98 wt. % recurring units from a hydrophobic non-ionic vinyl monomer. The polymers are useful in aqueous coating compositions, for coating onto discharge-treated polyester film supports to form cross-linked layers to promote adhesion between the film support and other emulsion layers in photographic elements such as silver halide emulsion layers. U.S. Pat. No. 5,639,589 and EP Pat. Appl. No. 729,063 describe polyester photographic film supports comprising a surface coated with a subbing layer comprising a mixture of gelatin and the same polymer composition described in U.S. Pat. No. 4,689,359. High dry adhesion even with a thinner subbing layer and/or higher gelatin:polymer ratio is obtained.

U.S. Pat. No. 4,213,783 discloses subbing layers for polyester film supports comprising copolymers of 75 to 90 mole % of vinylidene chloride, 2 to 16 mole % of acrylonitrile or methacrylonitrile or a copolymerizable ester, 0.5 to 5 mole % of itaconic acid or a monoalkyl ester of itaconic acid, wherein the alkyl group contains 1 to 4 carbon atoms and 3 to 8 mole % of acrylamide, methacrylamide or N-methylol-acrylamide.

U.S. Pat. No. 5,532,118 discloses photographic element comprising a polyester film support having coated thereon a self-crosslinkable polyurethane derived from an isocyanate terminated prepolymer extended with an aliphatic polyamine and end-capped with N-methylol hydrazide groups, the prepolymer being derived from a diisocyanate and a polyester polyol and having pendant water dispersing, carboxylic salt groups on the polymer chain. The photographic element disclosed therein exhibits good wet adhesion and dry adhesion, before and after photographic processing.

U.S. Pat. No. 4,329,423 discloses a light-sensitive photographic film, which comprises a support base, a copolymeric subbing layer applied to at least one surface of said base and a light-sensitive photographic emulsion layer bonded directly to the copolymeric subbing layer, said copolymeric subbing layer comprising a copolymer prepared from a comonomer mixture consisting essentially of 35 to 55 mole % acrylic acid or a lower alkyl ester, 35 to 55 mole % methacrylic acid or a lower alkyl ester thereof, and 1 to 15 mole % of itaconic acid or itaconic anhydride and 0 to 8 mole % of additional monomer selected from the class consisting of acrylamide, methacryl-amide, N-methylol acrylamide, etc.

U.S. Pat. No. 4,123,277 discloses a photographic element which comprises a support having superimposed thereon an adhesion promoting layer of a composition comprising a copolymer containing a) an N-alkanolamide moiety or an N-alkoxyal-kylamide moiety, b) a monomer which provides a carboxyl group and c) a hydrophobic monomer, and a hydrophilic colloid layer coated on said adhesion promoting layer, said hydrophilic colloid layer containing light-sensitive silver halide emulsion, physical development nuclei as used in a diffusion transfer process or diazo compounds.

U.S. Pat. No. 5,510,233 discloses a photographic material having a first and a second adhesion promoting layer and an emulsion layer coated in this order on a same side of a polyester support base, in which the first adhesion promoting layer is a hardened layer comprising polyurethane latex and an ethoxy compound or a dichloro-s-triazine derivative, and the second adhesion promoting layer is a hydrophilic colloid layer substantially consisting of gelatin. The polyurethane latex has breaking elongation lower than 300% or tensile stress of at least 130 kg/cm2 at 100% elongation. The composition of the adhesion promoting layers improves adhesion between emulsion layer and the support and prevents delamination even under prolonged storage at high humidity. condition. It also prevents emulsion from cracking even at extremely low humidity storage. Additional advantage is the resistance against reticulation at the processing and the background clarity of the processed images.

U.S. Pat. No. 4,339,531 discloses a coated film base suitable for coating with a light-sensitive photographic emulsion layer comprising a self-supporting film of a synthetic linear polyester and a continuous layer applied to at least one surface of said self-supporting film comprising a water-insoluble polymer of (a) styrene or a derivative of styrene, (b) a comonomer selected from acrylic acid, methacrylic acid or a derivative of acrylic acid or methacrylic acid and (c) a copolymerizable sulphonated ethylenically unsaturated comonomer. Photographic emulsions adhere strongly to the layer, especially after corona discharge treatment.

U.S. Pat. No. 4,571,363 describes a melt-extruded, oriented, self-supporting polyester film having an extensive crosslinked acrylic adhesion promoter coating on one or both sides. The adhesion promoter coating consists essentially of a crosslinked copolymer containing at least 50% by weight of acrylic and/or methacrylic monomers, from 1% to 15% by weight of a comonomer capable of intermolecular crosslinking upon the application of heat, and up to 49% by weight of halogen-free monoethylenically unsaturated monomers copolymerizable therewith.

PCT Patent Application No. 94–13,481 discloses a biaxially oriented copolyester film coated on one or both sides with vinyl acetate polymers which render the copolyester film surface receptive to additional reprographic or matte coatings applied thereto.

British Patent No. 1,496,967 discloses a polymeric priming layer applied to at least one side of a support film and a resinous hydrophilic layer applied thereto, the priming layer comprising a complete or partial salt of a polymer of acrylic and/or methacrylic acid that has been crosslinked with the aid of a crosslinking agent.

U.S. Pat. No. 5,514,528 discloses a photographic element having a polyester support carrying a light-sensitive layer on one surface and an antistatic layer containing a conductive metal oxide in a hydrophilic binder on the other surface. A subbing layer consisting of an addition or condensation polymer is provided between the support and the antistatic layer. Preferably the subbing layer is an addition polymer containing a vinylidene chloride/acrylonitrile copolymer or vinylidene chloride/acrylonitrile/acrylic acid terpolymer. The element is resistant to formation of minute areas where a loss of adhesion occurs between adjacent layers, in the backing layers.

It is desirable to provide polyester film supports having improved adhesion of emulsion layers coated thereon before, during and after photographic processing.

SUMMARY OF THE INVENTION

A photographic element comprising a film support base, an adhesion promoting layer, a subbing layer and at least one light-sensitive silver halide emulsion layer, wherein the adhesion promoting layer is close to the support and contains a self-crosslinkable vinyl addition copolymer and the subbing layer is positioned between the adhesion promoting layer and the emulsion layer.

The present invention also refers to a photographic element comprising a film support base having coated on. one side thereof at least one light-sensitive silver halide emulsion layer and on the opposite side thereof an adhesion promoting layer and at least one auxiliary layer, wherein the adhesion promoting layer is close to the support and contains a self-crosslinkable vinyl addition copolymer.

The present invention further refers to a film support base having coated on at least one. side thereof an adhesion promoting layer and a subbing layer, wherein the adhesion promoting layer is close to the support and contains a self-crosslinkable vinyl addition copolymer and the subbing layer is selected among the group consisting of a hydrophilic colloid layer or layers comprising a continuous gelled network of inorganic particles.

The adhesion of emulsion layers and/or of auxiliary layers to the support base are improved both in wet and dry conditions.

DETAILED DESCRIPTION

The layers of the photographic element can be coated on a variety of supports, such as cellulose ester supports (e.g., cellulose triacetate supports), paper supports, polyester film supports (e.g., polyethylene terephthalate or PET film supports and polyethylene naphthalate or PEN film supports), and the like, as described in Research Disclosure 308119, Section XVII, 1989. Preferred supports are the polyester film supports, well known in the art and that can be prepared from any of the polyester compositions described, for example, in U.S. Pat. Nos. 2,943,937 or 2,627,088. Suitable polyesters for use as supports include those prepared from dicarboxylic acids or derivatives thereof, such as terephthalic acid, isophthalic acid, 2,6-naphthalene dicarboxylic acid, 2,7-naphthalene dicarboxylic acid, adipic acid, succinic acid and mixtures thereof and glycols, such as, ethylene glycole, propylene glycole, bytylene glycole, hexamethylene glycole, cyclohexane diol and mixtures thereof. Especially useful polyester film supports are polytethylene terephthalate (PET) or polyethylene naphthalate (PEN).

The supports preferably are initially treated with a surface activation treatment such as, for example, a corona discharge treatment, a glow discharge treatment, an active plasma treatment, a chemical treatment, a mechanical treatment, a UV treatment, flame and similar. The preferred methods are corona discharge treatment, as described, for example, in U.S. Pat. Nos. 4,055,685; 4,135,932; 4,220,471 and 5,194,291; and glow discharge treatment as described, for example, in U.S. Pat. Nos. 3,288,638; 4,451,497; 4,933,267 and 5,425,980.

Light-sensitive photographic elements generally consist in a film support base coated with at least one silver halide emulsion layer on one side thereof and auxiliary layers on the other side of the support. The adhesion promoting layer of the present invention is close to the support and it may be applied on the emulsion side or on the side opposite to the emulsion side.

The adhesion promoting layer may be applied to the film support either during the preparation of the film support or subsequently thereto. That is, in the preparation of film supports, the polymer is melt extruded into a sheet and subsequently oriented by stretching in both longitudinal and transversal directions and then treated by several steps including heat treating, heat relaxing, annealing and the like. The adhesion promoting layer may be applied at any stage in the known process of preparing photo-graphic film base, including before orienting, between the orienting steps, or before or after any of the subsequent steps in the preparation of the support. The application of the adhesion promoting layer is particularly advantageous after completion of the support.

The adhesion promoting layer contains a self-crosslinkable vinyl addition copolymer containing a) styrene monomers, b) acrylate monomers and c) self-crosslinkable monomers. Suitable examples of the styrene monomer include styrene, α-methylstyrene, o-methylstyrene, m-methylstyrene, p-methylstyrene, α-methyl-p-methylstyrene, halogenated styrenes, ethylstyrene, p-isopropylstyrene, p-t-butyl-styrene, 2,4-dimethylstyrene and divinylbenzene. They can be used either singly or in combination. Suitable acrylates are alkyl acrylates, such as, for example, methylacrylate, ethylacrylate, butylacrylate, dodecylacrylate, octylacrylate, methylmethacrylate, ethylmethacrylate, butylmethacrylate, dodecylmethacrylate, etc. Suitable self-crosslinkable monomers are, for example, represented by the formulas:

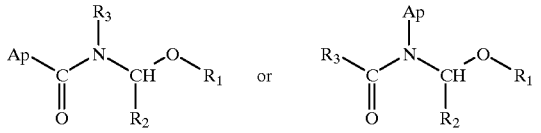

wherein $R_1$ and $R_2$ each represents a hydrogen atom or a substituted or unsubstituted alkyl group having 1 to 12 carbon atoms, $R_3$ represents a hydrogen atom or a substituted or unsubstituted hydrocarbon group having 1 to 12 carbon atoms, and Ap is a vinyl addition polymerizable group.

When, in the present invention, the term "group" or "nucleus" is used to describe a chemical compound or substituent, the described chemical material includes the basic group or nucleus and that group or nucleus with conventional substitution. Where the term "moiety" is used to describe a chemical compound or substituent, only the unsubstituted chemical material is intended to be included. For example, "alkyl group" includes not only such alkyl moieties as methyl, ethyl, octyl, etc., but also such moieties bearing substituent groups such as halogen, cyano, hydroxyl, nitro, amine, carboxylate, sulfo, sulfates, sulfonamides, alkyl, alkoxy, etc. On the other hand, "alkyl moiety" or "alkyl" includes only methyl, ethyl, octyl, etc.

Example of self-crosslinkable monomers include, for example, N-methylol acrylamide, N-methoxymethyl acrylamide, N-ethyl-N-methylol acrylamide, N,N-dimethylol acrylamide, N-α-hydroxyethyl acrylamide, N-α-hydroxypropyl acrylamide, N-methoxymethyl acrylamide, N-methylol methacrylamide, N-ethanol acrylamide, N-propanolacrylamide, N-butoxyethyl methacrylamide, N-ethanol methacrylamide, N-methyl acrylamide, N-tertiary-butylacrylamide, N-methylol maleamide, N-methylol-N-butyl acrylamide, N-methylol itaconamide, N-methylol-α-ethyl propionamide and vinyl aromatic compounds, vinyl ether derivatives and vinyl ester derivatives such as, for example, N-methylol-p-vinylbenzamide, N-methylol-β-vinyloxyethyl acetamide and N-methylol-vinyl-α-acetamide acetate, etc. One or more of these monomers can be selected depending on the purposes of use. Preferred monomers from the above are N-methylolacrylamide and N-methylolmethacrylamide, mainly because copolymer chains containing one of these monomers are capable of condensing with one another with the application of heat to form the desired inter-molecular crosslinking. In the case of copolymers containing other functional monomers, it is necessary to form blends of two or more copolymers containing different functional comonomers to achieve the desired crosslinking, e.g. blending a vinyl acetate/crotonic acid copolymer with a vinyl acetate copolymer containing isocyanate, epoxide or N-methylol functionality capable of reacting with acidic functional groups.

The preferred self-crosslinkable copolymers for the purposes of this invention includes the copolymers essentially consisting in styrene-methylacrylate-N-methylolacrylamide, styrene-ethylacrylate-N-methylolacrylamide, styrene-methylacrylate-N-methylol-methacrylamide or styrene-ethylacrylate-N-methylol-methacrylamide. Proportion of styrene monomers in the copolymer is generally 10–90% by weight, proportion of acrylate monomers in the copolymer is generally 10–90% by weight and proportion of self-crosslinkable monomer in the copolymer is generally 0.01–10% by weight. Copolymers useful for the present invention and available in the market are, for example, Hycar™ 26288, Hycar™ 26315, Carboset™ Ga 1103 and Carboset™ Ga 1105, produced by BF Goodrich Co.

The adhesion promoting layer can contain an additional adhesion promoter.

Suitable adhesion promoters are, for example, silane derivatives, such as epoxy silane derivatives.

When the adhesion promoting layer is applied on the emulsion side, a subbing layer is directly bonded to the adhesion promoting layer and is positioned between it and the silver halide emulsion layer in order to better improve the adhesion of the emulsion layer to the adhesion promoting layer. Subbing layers include hydrophilic colloid layers or layers comprising a continuous gelled network of inorganic particles.

Suitable hydrophilic colloidal materials include both naturally occurring substances such as proteins, protein derivatives, cellulose derivatives such as cellulose esters; gelatin including alkali-treated and acid-treated gelatin, phthalated gelatin, and the like; polysaccharides such as dextran, gum arabic, zein, casein, pectin, collagen derivatives, collodion, agar-agar, arrowroot, albumin and the like. The hydrophilic colloid layer composition preferably comprises a dispersion of the hydrophilic colloid in water at a percentage of at least 2% by weight of the resulting composition. Gelatin is the most preferred hydrophilic colloid. Other hydrophilic colloidal materials which can be used include poly(vinyllactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkyl-acrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like. Other exemplary colloids are disclosed, for example in U.S. Pat. Nos. 2,691,582; 2,787,545; 2,956,880; 3,132,945; 3,138,846; 3,679,425; 3,706,564; 3,813,251; 3,852,073; 3,879,205; 3,003,879; 3,284,207; 3,748,143 and 3,536,491.

Suitable layers comprising a continuous gelled network of inorganic particles are disclosed in U.S. Pat. No. 5,204,219. Inorganic metal oxides particularly suitable are those in which the metal oxide particles are negatively charged, which includes tin oxides, titanium oxides, antimony oxides, silica, and alumina-coated silica as well as other inorganic metal oxides of Groups III and IV of the Periodic Table and mixtures thereof. The selection of the inorganic metal oxides is dependent upon the ultimate balance of properties desired. Inorganics such as silicon nitride, silicon carbide, and magnesium fluoride when provided in sol form are also useful. When the adhesion promoting layer is coated on the polyester film support base on the side opposite to the emulsion side, auxiliary layers including, for example, antistatic layers, anti-halation layers, magnetic layers, protective or lubricant layers can be directly overcoated onto the adhesion promoting layer, without the need of a subbing layer. Antistatic layers and anti-halation layers are disclosed, for example, in Research Disclosure, Item 17643, December 1978 to prevent undesirable static discharges during manufacture, exposure and processing of the imaging element. Antistatic layers conventionally used in color films have been found to be satisfactory used herewith. Any of the antistatic agents described, for example, in U.S. Pat. Nos. 4,374,924; 4,943,520; 5,147,768 and 5,582,963 can be used. Preferred antistatic agents include metal oxides, such as, for example, tin oxide, antimony doped tin oxide, vanadium pentoxide, antimony doped vanadium pentoxide, silver doped vanadium pentoxide and mixtures thereof as described, for example, in U.S. Pat. Nos. 5,407,603; 5,427,835; 5,439,785; 5,468,498 and 5,709,985. Transparent magnetic recording layers as described, for example, in U.S. Pat. Nos. 5,147,768; 5,215,874; 5,217,804; 5,250,404 and 5,395,743, are useful to record magnetic information. Ferromagnetic particles are generally employed in such magnetic layers. Protective or lubricating layers can contain known compounds such as, for example, suitable lubricants including silicone oil, silicones having polar groups, higher fatty acid glycerides, higher alcohol esters of higher fatty acids, waxes, alcohols, polyolefins, alkyl phosphates, alkyl sulfates, siloxanes and the like, as described, for example, in European Patent Applications Nos. 751,423; 833,194 and 855,619 and in U.S. Pat. Nos. 5,723,270; 5,747,234; 5,766,836; 5,821,027; 5,843,631 and 5,491,051.

Suitable silver halide emulsion can be any of the silver halide emulsions known in the art such as silver chloride, silver bromide, silver bromo-chloride, silver chloro-iodide, silver bromo-iodide, silver chloro-bromo-iodide emulsions and mixtures thereof. The emulsions can be composed of coarse, medium and fine grains and can be monodispersed or polydispersed. The silver halide grains may be those having a regular crystal form, such as a cube or an octahedron, or those having an irregular crystal form, such as spherical or tabular, etc., or may be those having a composite crystal form. They may be composed of a mixture of grains having different crystal forms. Their size can be varied on a wide range, but in general average grain sizes from 0.1 to 4 $\mu$m are suitable.

The silver halide emulsions may be obtained according to any of the known acid, neutral and ammoniacal method using conventional precipitation methods such as a single or twin jet method. Further, the silver halide emulsions may be chemically sensitized with a sulfur sensitizer, such as allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination.

Furthermore, the above silver halide emulsions may contain various known additives for photography. For example, there may be employed additives for photography as disclosed in Research Disclosure, Item 17643, December 1978. Specifically hydrophobic photographic additives include dye-forming couplers, development-inhibitor-releasing (DIR) couplers, silver halide developers, oxidized developer scavengers, spectral sensitizers and desensitizers, diffusion transfer dye image-formers, visible and ultraviolet light absorbers, which are conventionally introduced in hydrophilic colloid layers of photographic elements dispersed in water-immiscible high boiling solvents. Other hydrophobic photographic additives include those used in silver halide photographic elements such as optical brighteners, antioxidants, silver halide solvents, bleachable dyes and the like. Hydrophobic photographic additives for use in the present invention are described in more details in Research Disclosure 15930, July 1977.

Moreover, the silver halides may be optically sensitized to a desired region of the visible spectrum. The method for spectral sensitization is not particularly limited. For example, optical sensitization may be possible by using an optical sensitizer, including a cyanine dye, a merocyanine dye, complex cyanine and merocyanine dyes, oxonol dyes, hemioxonol dyes, styryl dyes and streptocyanine dyes, either alone or in combination. Particularly useful optical sensitizers are the dyes of the benzoxazole-, benzimidazole- and benzothiazole-carbocyanine type.

The above emulsions may also contain various additives conveniently used depending upon their purpose. These additives include, for example, stabilizers or anti-foggants such as azaindenes, triazoles, tetrazoles, imidazolium salts, polyhydroxy compounds and others; film hardeners such as of the aldehyde, aziridine, isoxazole, vinylsulfone, acryloyl, triazine type, etc.; developing promoters such as benzyl alcohol, polyoxyethylene type compounds, etc.; image stabilizers such as compounds of the chromane, cumarane, bisphenol type, etc. Also, coating aids, surfactants for improved coatability, modifiers of the permeability in the processing liquids, defoaming agents, and matting agents, such as, polymethyl methacrylate beads, may be used if desired. Further, the auxiliary layer may contain a lubricant, such as wax. Suitable lubricants include silicone oil, silicones having polar groups, higher fatty acids glycerides, higher alcohol esters of higher fatty acids, and the like, as described, for example, in U.S. Pat. No. 5,532,118.

The photographic emulsions can be used for black-and-white light-sensitive negative elements, light-sensitive positive elements, X-Ray elements, lithographic elements, black-and-white and color light-sensitive elements for diffusion transfer processes and light-sensitive elements which contain oil-soluble or water-soluble color couplers.

Preferably, the silver halide emulsions are designed for multicolor elements comprising dye image forming units sensitive to each of the three primary regions (blue, green and red) of the visible spectrum. Each unit can be formed by a single emulsion layer or multiple emulsion layers sensitive to the same spectral region.

More preferably, the silver halide emulsions are designed for a multicolor element comprising a support bearing at least one blue-sensitive silver halide emulsion layer and preferably two blue-sensitive silver halide emulsion layers of different sensitivity associated to yellow dye forming couplers, at least one green sensitive silver halide emulsion layer and preferably at least two green-sensitive silver halide emulsion layers of different sensitivity associated to magenta dye forming couplers, at least one red-sensitive silver halide emulsion layer and preferably at least two red-sensitive silver halide emulsion layers of different sensitivity associated to cyan dye forming couplers, and additional non light-sensitive hydrophilic colloid layers (such as protective layers, intermediate layers, filter layers, subbing layers, backing layers and the like), wherein at least one component layer of said material comprises incorporated therein a hydrophilic photographic additive dispersed with the aid of a water-immiscible high boiling organic solvent according to the present invention, said component layers comprising preferably at least one silver halide emulsion layer including a dye forming coupler.

The photographic elements can be processed after exposure to form a visible image. Processing can be the common processing employed to develop color photographic elements. A negative colored image can be obtained by color development followed by bleaching and fixing. Development is obtained by contacting the exposed silver halides of the element with an alkaline aqueous medium in the presence of an aromatic primary amine color developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylenediamine derivatives, especially the N,N-dialkyl-p-phenylenediamine derivatives wherein the alkyl groups or the aromatic nucleus can be substituted or not substituted.

Examples of p-phenylenediamine developers include the salts of: N,N-diethyl-p-phenylenediamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (gene-rally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(β-hydroxyethyl)-aniline sulfate (generally known as CD4 and used in the developing solutions for color negative photographic materials).

The color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g., EDTA.Fe.$NH_4$, wherein EDTA is the ethylenediamino-tetracetic acid, or PDTA.Fe.$NH_4$, wherein PDTA is the propylenediaminotetraacetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The invention will be further illustrated by the following examples.

EXAMPLE 1

Sample 1 (comparison). A biaxially oriented and annealed polyethylene naphthalate support base has been subjected to a corona discharge treatment at 1.5 J/$cm^2$ and then overcoated with an adhesion promoting layer containing 270 mg/$m^2$ of Carboset™ GA1105, which is a self-crosslinkable vinyl addition copolymer mainly consisting in styrene/ethylacrylate/N-methylolacrylamide. The adhesion promoting layer further contained 27 mg/$m^2$ 3-glycidyloxypropyl trimethoxysilane compound as adhesion promoter, 1 mg/$m^2$ of polymethylmethacrylate beads having an average diameter of 1.5 μm. The adhesion promoting layer has been overcoated by a coating hopper with a silver halide emulsion layer containing 1.3 g/$m^2$ of silver, 2.7 g/$m^2$ of gelatin, 197.3 mg/$m^2$ of dichlorotriazine hardener, 289.1 mg/$m^2$ of a magenta masking coupler, 112.0 mg/$m^2$ of Dye 1 and 233.1 mg/$m^2$ of Dye 2.

Sample 2 (invention) has been prepared as Sample 1, but a hydrophilic subbing layer has been coated between the adhesion promoting layer and the emulsion layer. The subbing layer contained 141 mg/$m^2$ of gelatin, 2.8 mg/$m^2$ of chrome alume.

Sample 3 (invention) has been prepared as Sample2, but the Carboset™ GA1105 compound has been replaced, with the same amount, by Carboset™ GA1103, which is a self-crosslinkable vinyl addition copolymer mainly consisting in styrene/ethylacrylate/N-methylolacrylamide.

Sample 4 (comparison) has been prepared as Sample2, but the Carboset™ GA1105 compound has been replaced, with the same amount, by Carboset™ XPD2236, a non self-crosslinkable vinyl addition polymer produced by BF Goodrich Co.

Sample 5 (comparison) has been prepared as Sample 2, but the Carboset™ MGA1105 compound has been replaced, with the same amount, by Carboset™ GA2136, a non self-crosslinkable vinyl addition polymer produced by BF Goodrich Co.

Sample 6 (comparison) has been prepared as Sample 2, but the Carboset™ GA1105 compound has been replaced, with the same amount, by Neocryl™ A-1052, a non self-crosslinkable vinyl addition polymer produced by BF Goodrich Co.

Sample 7 (comparison) has been prepared as Sample 2, but the Carboset™ GA1105 compound has been replaced, with the same amount, by Witcobond™ 240, a condensation polymer of the self-crosslinkable polyurethane type, disclosed in U.S. Pat. No. 5,532,118 and produced by Witco Co.

Sample 8 (invention) has been prepared as Sample 2, but the subbing layer was made of a continuous gelled network of inorganic particles containing 37.5 mg/m$^2$ of 3-aminopropyltriethoxysilane compound, 375 mg/m$^2$ of colloidal silica.

Sample 9 (invention) has been prepared as Sample 3, but using the same subbing layer of Sample 8.

Sample 10 (comparison) has been prepared as Sample 4, but using the same subbing layer of Sample 8.

Sample 11 (comparison) has been prepared as Sample 5, but using the same subbing layer of Sample 8.

Sample 12 (comparison) has been prepared as Sample 6, but using the same subbing layer of Sample 8.

Samples 1–12 have been incubated (2 hours, 38° C., 50% RH) and evaluated for both wet and dry adhesion in the following manner.

Dry Adhesion Test: the coating has been scored with a razor blade in a grid pattern (5 lines, 5 mm apart and another 5 lines at a 60° angle to the first set). A piece of 610 Scotch™ tape has been applied over the scored area and the tape is pulled off by hand. The amount of adhesion has been ranked using scholastis scores from 0 (no adhesion) to 10 (excellent adhesion).

Wet Adhesion Test: A 35 mm strip of the coating has been scored with a razor blade as above and placed in small troughs filled with developing, bleaching and fixing solutions. A weighted filled natural rubber pad has been placed on top and repeatedly moved back and forth across the strip, with a pression of 1.5 Kg on the strip. The same scholastic scores of above have been used.

Dry Adhesion Test After Development: the same dry adhesion test of above has been repeated after the sample has been developed and dried at 40° C.

The results are reported in the following Table 1.

TABLE 1

| Samples | Subbing layer: Hydrophilic colloid | Subbing layer: Gel network of inorganic particles | Self-crosslinkable vinyl addition polymer in adhesion promoting layer | Dry Adhesion Test | Wet Adhesion Test | Dry Adhesion Test After Development |
|---|---|---|---|---|---|---|
| Sample 1 (comp.) | NO | NO | YES | 2 | 0 | 0 |
| Sample 2 (inv.) | YES | NO | YES | 10 | 10 | 10 |
| Sample 3 (inv.) | YES | NO | YES | 8 | 10 | 10 |
| Sample 4 (comp.) | YES | NO | NO | 2 | 10 | 2 |
| Sample 5 (comp.) | YES | NO | NO | 3 | 7 | 3 |
| Sample 6 (comp.) | YES | NO | NO | 2 | 9 | 2 |
| Sample 7 (comp) | YES | NO | NO | 0 | 0 | 6 |
| Sample 8 (inv.) | NO | YES | YES | 10 | 10 | 10 |
| Sample 9 (inv.) | NO | YES | YES | 10 | 10 | 10 |
| Sample 10 (comp.) | NO | YES | NO | 0 | 10 | 3 |
| Sample 11 (comp.) | NO | YES | NO | 2 | 9 | 4 |
| Sample 12 (comp.) | NO | YES | NO | 2 | 9 | 9 |

Table 1 shows that comparison Sample 1, even if containing a self-crosslinkable vinyl addition polymer in the adhesion promoting layer, is not useful to the purpose of the present invention because presents bad dry and wet adhesion performances, caused by the absence of a subbing layer positioned between the adhesion promoting layer and the emulsion layers. Comparison Samples Nos. 4–7 and 10–12 are also not useful to the purpose of the present invention because presents bad dry and wet adhesion performances, caused by the absence of a self-crosslinkable vinyl addition polymer in the adhesion promoting layer, even if they do contain a subbing layer positioned between the adhesion promoting layer and the emulsion layers (Samples Nos. 4–7 contained a hydrophilic colloid type subbing layer, while Samples 10–12 contained a subbing layer made of gel network of inorganic particles).

Only Samples 2–3 and 8–9 showed good wet and dry adhesion performance, due to the contemporaneous presence of a self-crosslinkable vinyl addition polymer in the adhesion promoting layer and of a subbing layer positioned between the adhesion promoting layer and the emulsion layers.

Dye 1

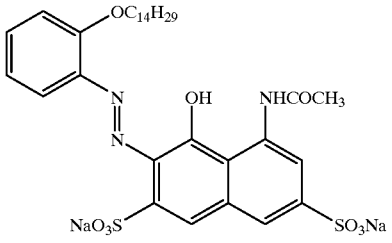

-continued

Dye 2

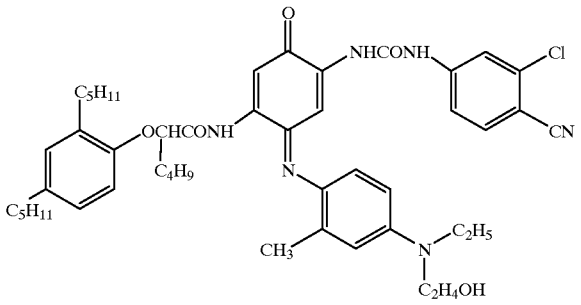

EXAMPLE 2

Sample 14 (invention). A biaxially oriented and annealed polyethylene naphthalate support base has been subjected to a corona discharge treatment at 1.5 J/cm$^2$ and then overcoated, in the side opposite to the emulsion side, with an adhesion promoting layer containing 270 mg/m$^2$ of Carboset™ m GA1105, which is a self-crosslinkable vinyl addition copolymer mainly consisting in styrene/ethylacrylate/N-methylolacrylamide. The adhesion promoting layer further contained 27 mg/m$^2$ 3-glycidyloxypropyl trimethoxysilane compound as adhesion promoter, 1 mg/m$^2$ of polymethylmethacrylate beads having an average diameter of 1.5 $\mu$m. The adhesion promoting layer has been overcoated with an antistatic layer containing 3.72 mg/m$^2$ of vanadium pentoxide, 300 mg/m$^2$ of a vinylidene chloride-methylmethacrylate-acrylonitrile copolymer, 30 mg/m$^2$ of 3-glycidyloxypropyl trimethoxysilane.

Sample 15 (comparison) has been prepared as Sample 14, replacing Carboset™ GA1105 with the same amount of Carboset™ m GA2136, a non self-crosslinkable vinyl addition polymer produced by BF Goodrich Co.

Sample 16 (comparison) has been prepared as Sample 14, but with no adhesion promoting layer, the antistatic layer being directly close to the support base.

The results are reported in the following Table 2.

TABLE 2

| Samples | Self-crosslinkable polymer in adhesion promoting layer | Dry Adhesion Test | Wet Adhesion Test | Dry Adhesion Test After Development |
|---|---|---|---|---|
| Sample 14 (inv.) | YES | 10 | 10 | 10 |
| Sample 15 (comp.) | NO | 10 | 0 | 10 |
| Sample 16 (comp.) | NO | 10 | 0 | 10 |

Table 2 shows that Sample 14 is useful to the purpose of the present invention because presents good dry and wet adhesion performances, caused by the presence of a self-crosslinkable vinyl addition polymer in the adhesion promoting layer. Sample 15, wherein a self-crosslinkable vinyl addition polymer is not present, and Sample 16, wherein the adhesion promoting layer is not present, caused bad wet adhesion results.

What is claimed is:

1. A photographic element comprising a film support base, an adhesion promoting layer, a subbing layer comprising a continuous gelled network of inorganic particles and at least one light-sensitive silver halide emulsion layer, wherein the adhesion promoting layer is close to the support and contains a self-crosslinkable vinyl addition copolymer and the subbing layer is positioned between the adhesion promoting layer and the emulsion layer.

2. A photographic element of claim 1, wherein the self-crosslinkable vinyl addition copolymer contains styrene monomers, acrylate monomers and self-crosslinkable monomers.

3. A photographic element of claim 2, wherein the self-crosslinkable monomers are represented by the formulas:

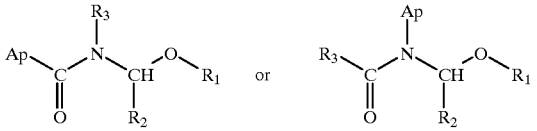

wherein $R_1$ and $R_2$ each represents a hydrogen atom or a substituted or unsubstituted alkyl group having 1 to 12 carbon atoms, $R_3$ represents a hydrogen atom or a substituted or unsubstituted hydrocarbon group having 1 to 12 carbon atoms, and Ap is a vinyl addition polymerizable group.

4. A photographic element of claim 1, wherein the self-crosslinkable vinyl addition copolymer contains a self-crosslinkable monomer selected from N-methylolacrylamide or N-methylolmethacrylamide.

5. A photographic element of claim 1, wherein the self-crosslinkable polymer is selected from styrene-methylacrylate-N-methylolacrylamide copolymer, styrene-ethylacrylate-N-methylolacrylamide copolymer, styrene-methylacrylate-N-methylol-methacrylamide copolymer and styrene-ethylacrylate-N-methylol-methacrylamide copolymer methacrylamide copolymer and styrene-ethylacrylate-N-methylol-methacrylamide copolymer.

6. A photographic element of claim 2, wherein the proportion of self-crosslinkable monomer in the copolymer is in the range from 0.01 to 10% by weight.

7. A photographic element of claim 1, wherein the subbing layer is a hydrophilic colloid subbing layer.

8. A photographic element of claim 7, wherein the hydrophilic colloid type subbing layer is made of gelatin.

9. A photographic element of claim 1, wherein said inorganic particles are silica compounds.

10. A photographic element comprising a film support base, an adhesion promoting layer, a subbing layer and at least one light-sensitive silver halide emulsion layer, wherein the adhesion promoting layer is close to the support and contains a self-crosslinkable vinyl addition copolymer and the subbing layer is positioned between the adhesion promoting layer and the emulsion layer, wherein the adhesion promoting layer further contains an additional adhesion promoter selected from the group of epoxy silane compounds.

11. A photographic element comprising a film support base having coated on one side thereof at least one light-sensitive silver halide emulsion layer and on the opposite side thereof an adhesion promoting layer and at least one auxiliary layer, wherein the adhesion promoting layer is close to the support and contains a self-crosslinkable vinyl addition copolymer and an additional adhesion promoter selected from the group o f epoxy silane compounds.

12. A photographic element of claim 11, wherein the self-crosslinkable vinyl addition copolymer contains styrene monomers, acrylate monomers and self-crosslinkable monomers.

13. A photographic element of claim 12, wherein the self-crosslinkable monomers are represented by the formulas:

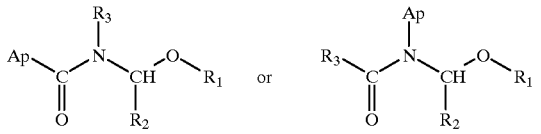

wherein $R_1$ and $R_2$ each represents a hydrogen atom or a substituted or unsubstituted alkyl group having 1 to 12 carbon atoms, $R_3$ represents a hydrogen atom or a substituted or unsubstituted hydrocarbon group having 1 to 12 carbon atoms, and Ap is a vinyl addition polymerizable group.

14. A photographic element of claim 11, wherein the self-crosslinkable vinyl addition copolymer contains a self-crosslinkable monomer selected from N-methylolacrylamide or N-methylolmethacrylamide.

15. A photographic element of claim 11, wherein the self-crosslinkable polymer is selected from styrene-methylacrylate-N-methylolacrylamide copolymer, styrene-ethylacrylate-N-methylolacrylamide copolymer, styrene-methylacrylate-N-methylol-methacrylamide copolymer and styrene-ethylacrylate-N-methylol-methacrylamide copolymer.

16. A photographic element of claim 11, wherein the proportion of self-crosslinkable monomer in the copolymer is from 0.01 to 10% by weight.

17. A photographic element of claim 11, wherein the auxiliary layer is selected from the group consisting of an antistatic layer, a magnetic layer, a protective layer, a lubricant layer.

* * * * *

UNITED STATES PATENT AND TRADEMARK OFFICE

CERTIFICATE OF CORRECTION

PATENT NO. : 6,300,048 B1 
DATED : October 9, 2001
INVENTOR(S) : Paola Puppo, Carlo Barlocco and Alberto Valsecchi It is certified that error appears in the above-identified patent and that said Letters Patent is hereby corrected as shown below:

Title page,
Item [73], Assignee, insert -- Ferrania S.p.A., Ferrania, Savona, Italy (IT) --.

Signed and Sealed this

Twentieth Day of August, 2002

*Attest:*

*Attesting Officer*

JAMES E. ROGAN
*Director of the United States Patent and Trademark Office*